US007240780B2

(12) United States Patent
Nago et al.

(10) Patent No.: US 7,240,780 B2
(45) Date of Patent: Jul. 10, 2007

(54) APPARATUS FOR DISCRIMINATING VALUABLE PAPERS WITH CENTERING MEANS

(75) Inventors: Tokimi Nago, Sagamihara (JP); Kazuhiko Okamoto, Sagamihara (JP); Toru Seki, Sagamihara (JP)

(73) Assignee: Japan Cash Machine, Co., Ltd., Osaka (JP)

( * ) Notice: Subject to any disclaimer, the term of this patent is extended or adjusted under 35 U.S.C. 154(b) by 596 days.

(21) Appl. No.: 10/702,821

(22) Filed: Nov. 6, 2003

(65) Prior Publication Data

US 2005/0077215 A1 Apr. 14, 2005

(30) Foreign Application Priority Data

Oct. 10, 2003 (JP) ..... P2003-351790

(51) Int. Cl.
*G07F 7/04* (2006.01)
*B65H 9/00* (2006.01)

(52) U.S. Cl. ..... 194/206; 271/240

(58) Field of Classification Search ..... 194/206
See application file for complete search history.

(56) References Cited

U.S. PATENT DOCUMENTS 5,363,147 A 11/1994 Joseph et al.
5,368,147 A * 11/1994 Menke et al. ..... 194/206
5,411,249 A 5/1995 Zouzoulas
6,149,150 A 11/2000 Onipchenko et al.
6,158,565 A * 12/2000 Mikami et al. ..... 194/206
6,164,642 A * 12/2000 Onipchenko et al. ..... 271/240
6,730,010 B2 * 5/2004 Yamakawa et al. ..... 493/267

FOREIGN PATENT DOCUMENTS

JP 52-55288 4/1977
JP 6162310 6/1994
JP 9226986 9/1997
JP 2000149089 A 5/2000
JP 2002279487 9/2002
JP 2002279487 A 9/2002

* cited by examiner

*Primary Examiner*—Patrick Mackey
*Assistant Examiner*—Mark J. Beauchaine
(74) *Attorney, Agent, or Firm*—Bachman & LaPointe, P.C.

(57) ABSTRACT

An apparatus for discriminating valuable papers is provided wherein a validation control circuit 56 (i) drives conveyer device 8 to inwardly move bill along passageway 9 when inlet sensor 13 detects bill, (ii) ceases driving of conveyer device 8 to keep bill in the standby position in passageway 9 when trigger sensor 50 detects bill, (iii) drives a release device 42 to shift a guide roller 40 from the contact position to the separated position, (iv) activates a centering device 10 to centralize bill along the longitudinal central axis of passageway 9, (v) drives release device 42 to return guide roller 40 from the separated position to the contact position, and (vi) again drives conveyer device 8 to further inwardly move bill. When bill is inserted into an inlet 7, inlet sensor 13 detects bill to immediately drive conveyer device 8 and center bill on conveyer device 8 for smooth inserting, transporting and centering of bill with the reduced number of structural components of the apparatus.

10 Claims, 8 Drawing Sheets

APPARATUS FOR DISCRIMINATING VALUABLE PAPERS WITH CENTERING MEANS

TECHNICAL FIELD

This invention relates to a bill validator, in particular to an apparatus for discriminating valuable papers with centering means capable of centralizing banknotes of different widths along a longitudinal central axis of a banknote passageway in the apparatus.

BACKGROUND OF THE INVENTION

A bill validator is provided with a conveyer to transport a bill inserted from an inlet of the validator along a passageway when an inlet sensor detects the inserted bill, and a validation sensor is provided in the vicinity of the passageway to scan the moving bill to pick out and convert optical or magnetic feature of the bill into electric signals. In some kinds of bill validators, a centering device is provided to centralize bills of different widths along a longitudinal central axis of the passageway to assure the accurate validation of the bills even of different widths.

For example, U.S. Pat. No. 5,363,147 issued on Nov. 29, 1994 to Wilhelm Menke et al., discloses a testing device for banknotes that has a testing channel with a transport device and scanning devices for recognizing and checking the authenticity of the banknote. An input channel of variable width is in front of the testing channel. The input channel includes two channel halves, one on either side of the longitudinal center axis of the input channel. The two channel halves can be adjusted synchronously against the force of a spring. In their contact position, the channel halves determine the minimum width of the channel, and in their separated end position they determine the maximum width. A banknote of any type is introduced into the input channel at its locked maximum channel width as far as a passage detector arranged in a starting region of the testing channel. The passage detector unlocks the channel halves, as a result of which the side walls of the channel halves are pressed by the force of a spring against the banknote and align it centrally with the testing channel.

Japanese Patent Disclosure No. 2000-149089 to Y Saito et al., shows a bill handling apparatus that has a centering device provided before a bill validating device, and a transfer device for carrying a bill along a path in the centering device. The transfer device is provided independently from and in communication with a conveyer device provided in the bill validating device, and comprises upper and lower transfer units pivotally mounted on shafts to rotate between the incorporative position for carrying the bill along the path and the opened position for centering the bill. The upper transfer unit is rotated upwardly around one of the shafts in the counterclockwise direction from the incorporative to the opened position, and the lower transfer unit is rotated downwardly around the other of the shafts in the clockwise direction from the incorporative to the opened position to release the bill from the transfer device. Then, the bill is centralized by the centering device that comprises a pair of centering levers rotatable toward and away from each other between original and closer positions, a spring connected to each end of the centering levers for urging the centering levers toward the original position, and a pair of arms each connected to the centering lever. When the lower transfer unit is rotated in the clockwise direction to the opened position, the lower transfer unit is brought into contact to the arms to forcibly move the centering levers toward the closer position against resilient force of the spring so that the centering levers press each side edge of the bill for centering.

U.S. Pat. No. 6,149,150 to Oleksandr Onipchenko et al., demonstrates a banknote centering device that comprises an enlarged slot for receiving a banknote longitudinally, V-shaped side engaging members associated with the slot and movable from an open position either side of the slot to a narrow position defining a minimum position between the side engaging members, a banknote drive wheel formed with three corner engaging portions for driving a banknote from an insert position to a centering position where the banknote is free to move within the slot, and a drive arrangement for moving the side engaging members in a controlled manner towards one another and equally spaced either side of a centerline of the slot. The side engaging member drive arrangement includes a motor for accelerating the side engaging members from the open position towards the narrow position until further inward movement of the side engaging members is opposed by a resistance of the banknote to buckling which resistance stalls the motor drive.

Japanese Patent Disclosure No. 2002-279487 to Tokimi Nago et al., presents a bill validator that comprises a conveyer for inwardly transporting a bill inserted from an inlet along a passageway, a detection sensor for converting a physical feature of the bill passing through the passageway into electric signals, a discriminative controller for receiving the electric signals from the detection sensor to decide the authenticity of the bill and to drive the conveyer in response to the result of the authenticity decision, and a centering device mounted in the validator before the detection sensor for centrally aligning the bill moved along the passageway. The centering device comprises a pair of pinch jaws movable toward and away from each other on the opposite sides of the passageway, and a centering motor for driving the pinch jaws for the reciprocal movement. The centering motor is activated to move the pinch jaws toward each other after the bill is positioned between the pinch jaws so that the pinch jaws are brought into contact to side edges of the bill, thereby causing lateral movement of the pinch jaws to make the bill come coaxial with the passageway. The centering motor arrives at a power-swing damping when the bill comes coaxial with the passageway and the resistive force against deformation of the bill becomes greater than output torque of the centering motor, then, the centered bill is inwardly transported along the passageway by the conveyer.

However, prior art bill validating devices are defective in that, as the centering device is provided separately from and in communication to a conveyer device of a bill validating device, inserted bills cannot be smoothly shifted in a reduced period of time to the centering operation and subsequent transportation through the passageway in the bill validating device. Besides, the centering device requires the increased number of structural components and complicated structure.

An object of the present invention is to provide an apparatus for discriminating valuable papers capable of smoothly performing inserting, centering and transporting operations of the valuable papers. Another object of the present invention is to provide an apparatus for discriminating valuable papers that can exactly carry out centering operation of the valuable papers with lesser number of the structural components.

SUMMARY OF THE INVENTION

The apparatus for discriminating valuable papers according to the present invention comprises conveyer means (8) that has lower and upper transfer units (11, 12) to define a passageway (9) between the lower and upper transfer units (11, 12), centering means (10) that has a pair of pinch jaws (15) positioned on the opposite sides of an inlet (7) of the passageway (9), the pinch jaws (15) being movable toward and away from each other, an inlet sensor (13) disposed in the vicinity of the inlet (7) for detecting the valuable paper inserted from the inlet (7) between the lower and upper transfer units (11, 12) to produce a detection signal, a trigger sensor (50) disposed behind the inlet sensor (13) along the passageway (9) for detecting the paper moved to a standby position, release means (42) for shifting one of the lower and upper transfer units (11, 12) between a contact position wherein the one of the lower and upper transfer units (11, 12) is in contact to the other of the lower and upper transfer units (11, 12) and a separated position wherein the one is apart from the other, and validation control means (56) for controlling each drive of the conveyer means (8), centering means (10) and release means (42). The validation control means (56) continuously: (i) drives the conveyer means (8) to inwardly move the paper along the passageway (9) when the inlet sensor (13) detects the paper, (ii) ceases driving of the conveyer means (8) to keep the paper in the standby position in the passageway (9) when the trigger sensor (50) detects the paper, (iii) drives the release means (42) to shift one of the lower and upper transfer units (11, 12) from the contact position to the separated position, (iv) activates the centering means (10) to centralize the paper along the longitudinal central axis of the passageway (9), (v) drives the release means (42) to return the one of the lower and upper transfer units (11, 12) from the separated position to the contact position, and (vi) again drives the conveyer means (8) to further inwardly move the paper. Accordingly, the inlet sensor (13) detects inserted bill into inlet (7) to immediately move the paper on the conveyer means (8) and center the paper on the conveyer means (8) for smooth insertion, transportation and centering of the paper with the reduced number of structural components, thus resulting in easy production of the apparatus and fast and smooth sequential operations from the insertion to validation of the valuable paper.

BRIEF DESCRIPTION OF THE DRAWINGS

The above-mentioned and other objects and advantages of the present invention will be apparent from the following description in connection with preferred embodiment shown in the accompanying drawings wherein.

BEST MODE FOR CARRYING OUT THE INVENTION

Figure 1:
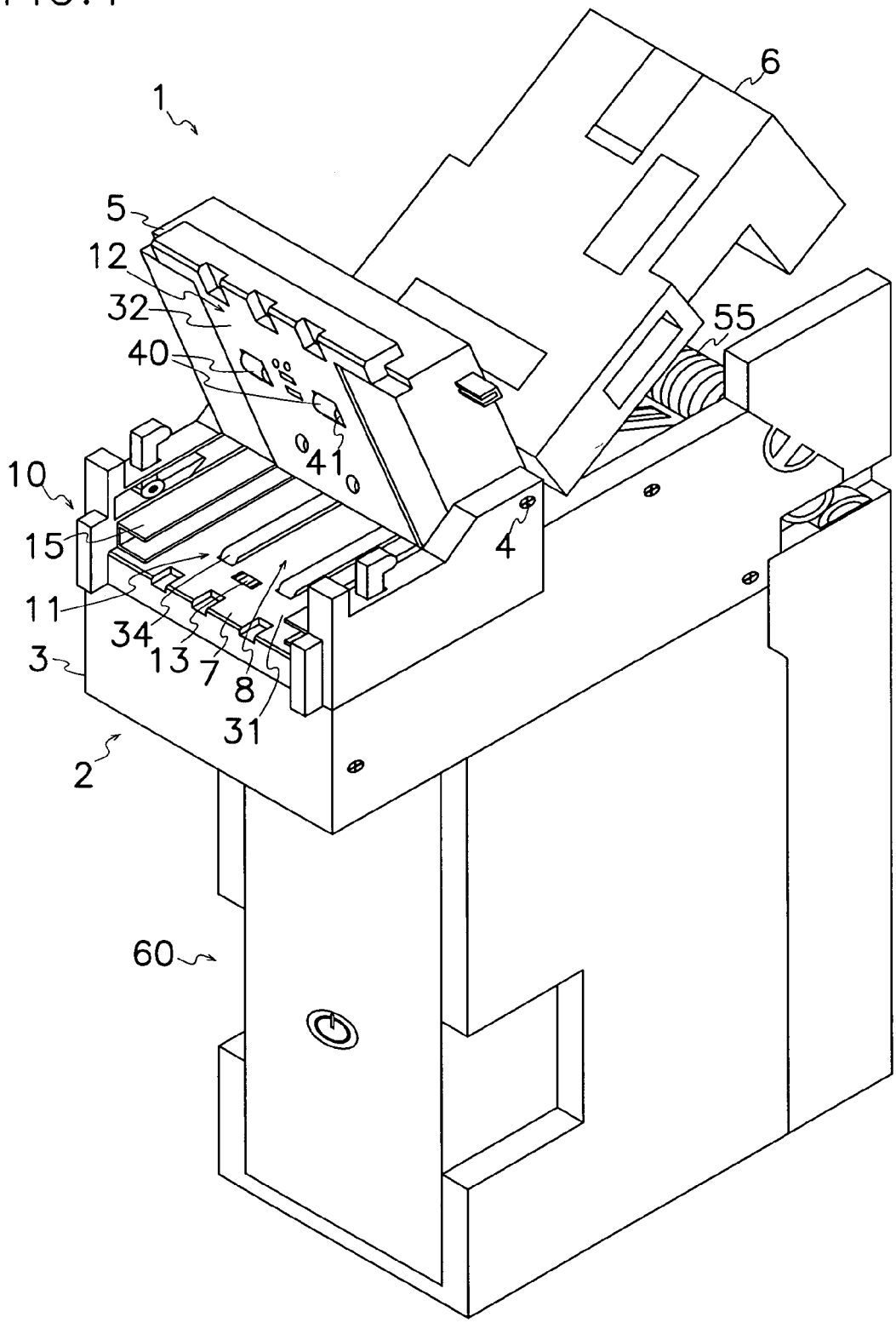
FIG. 1 is a perspective view of a bill validating apparatus according to the present invention.

An embodiment is described hereinafter of the apparatus for discriminating valuable papers according to the present invention applied to a bill validating apparatus. As shown in FIG. 1, the bill validating apparatus 1 comprises a validation control device 2 and a stacker device 60 removably attached to a bottom of validation control device 2. Stacker device 60 has a chamber (not shown) for accommodating and accumulating bills transported from validation control device 2.

Validation control device 2 comprises a case 3, front and rear blocks 5 and 6 each rotatably attached to case 3 by a shaft 4, an inlet sensor 13 disposed in the vicinity of inlet 7 for detecting bill inserted into inlet 7 to produce a detection signal, a centering device 10 for forcibly making bill align with a passageway 9 along the longitudinal central axis, a conveyer device 8 arranged inside centering device 10 for transporting bill along passageway 9, a trigger sensor 50 disposed behind inlet sensor 13 for detecting bill moved to a standby position, a validation sensor 14 disposed downstream trigger sensor 50 for converting a physical feature of bill moved through passageway 9 into electric signals. Conveyer device 8 has a lower transfer unit 11 provided with a lower guide 31 and an upper transfer unit 12 provided with an upper guide 32 mounted in vertically spaced relation to lower guide 31 to define passageway 9 between lower and upper guides 31, 32. Lower transfer unit 11 is secured to case 3, and upper transfer unit 12 is secured to front and rear blocks 5 and 6 formed with upper guide 32.

Arranged in case 3 beneath front block 5 is centering device 10 that has a pair of pinch jaws 15 disposed on the opposite sides of inlet 7 so that pinch jaws 15 are movable toward and away from each other. Lower and upper transfer units 11 and 12 are positioned between a pair of pinch jaws 15 of centering device 10. In this arrangement, when front and rear blocks 5 and 6 are upwardly rotated around shaft 4 to the opened position, passageway 9 is opened or accessible when jammed bill is easily removed from passageway 9.

Figure 4:
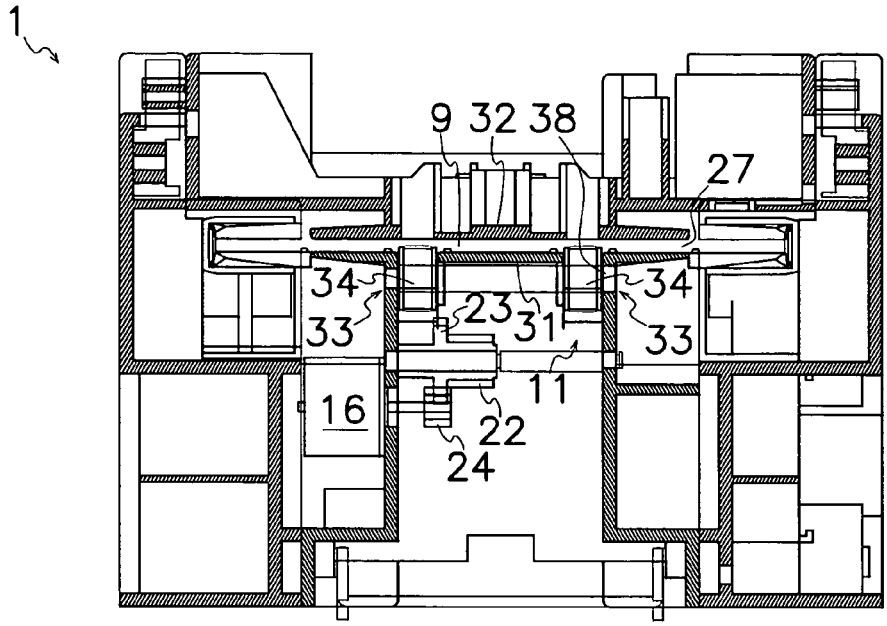
FIG. 4 is a cross sectional view taken along a line 4-4 of the bill validating apparatus shown in FIG. 2.

In the shown embodiment, lower transfer unit 11 comprises a pair of belt conveyers 33 each which comprises a belt 34 for carrying bill along passageway 9, a drive roller 35 and a plurality of idle rollers 36 around which belt 34 is wound, and a transport motor 37 drivingly connected to drive roller 35 through a suitable gear train or power transmission device not shown. As shown in FIG. 4, each belt 34 is located in an elongated slit 38 formed in lower guide 31 so that upper surface of belt 34 is positioned in a plane substantially flush with or slightly higher than upper surface of lower guide 31.

Figure 2:
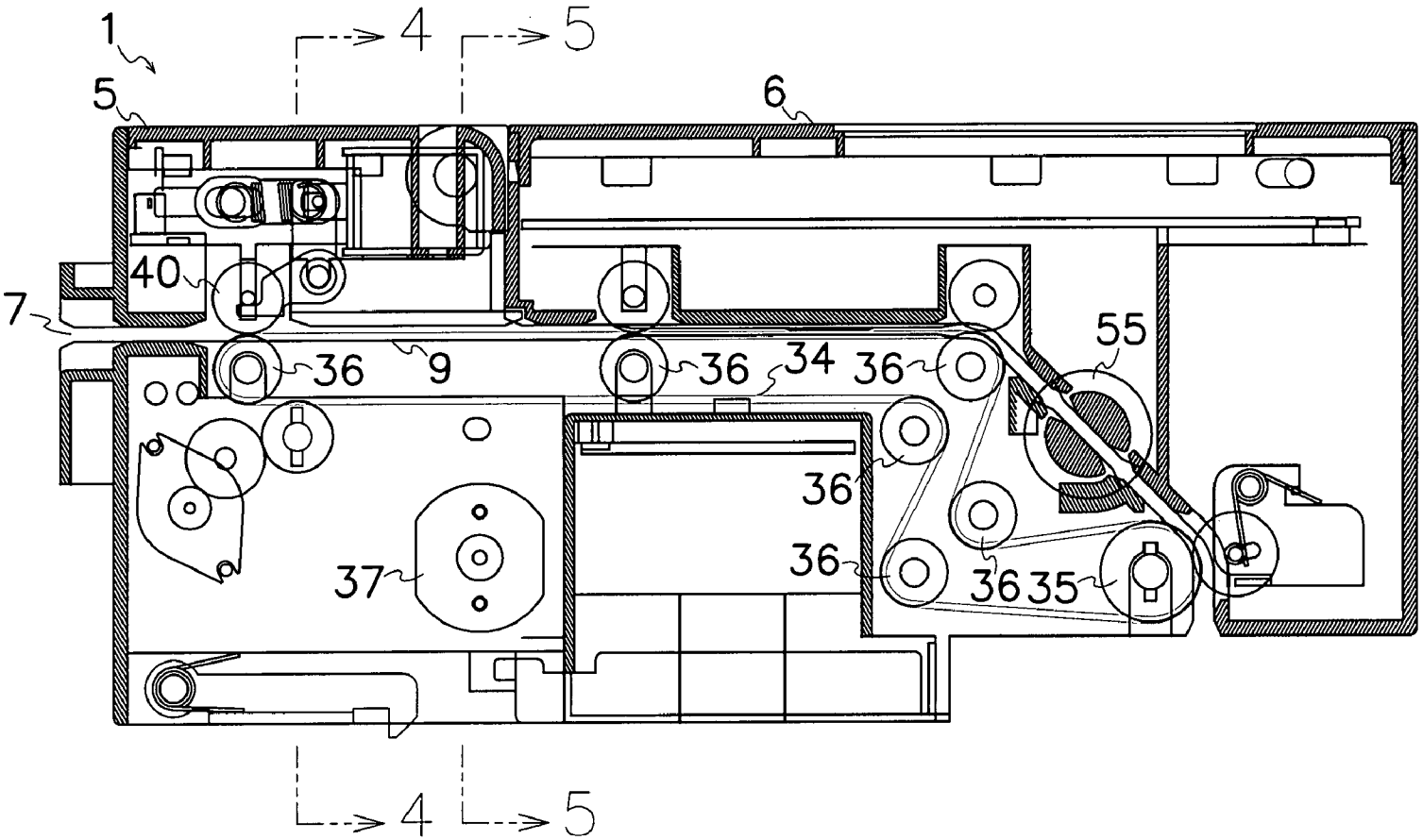
FIG. 2 is a cross sectional view taken along a line 2-2 of the bill validating apparatus shown in FIG. 5.
Figure 5:
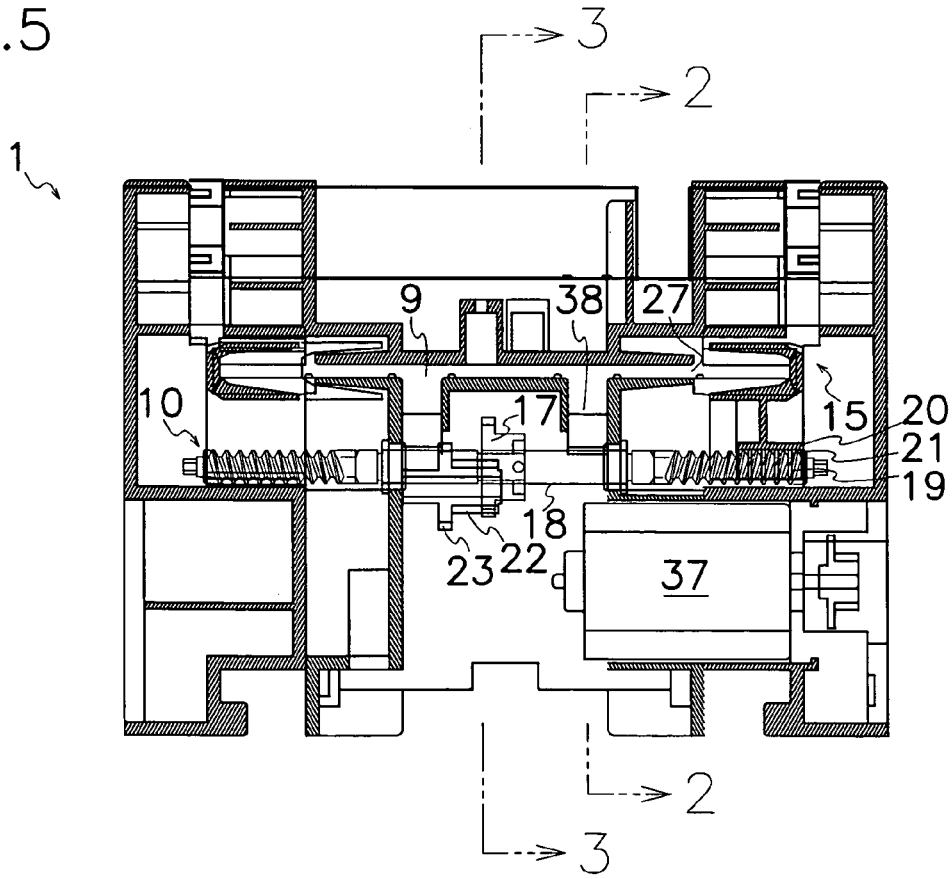
FIG. 5 is a cross sectional view taken along a line 5-5 of the bill validating apparatus shown in FIG. 2.
Figure 6:
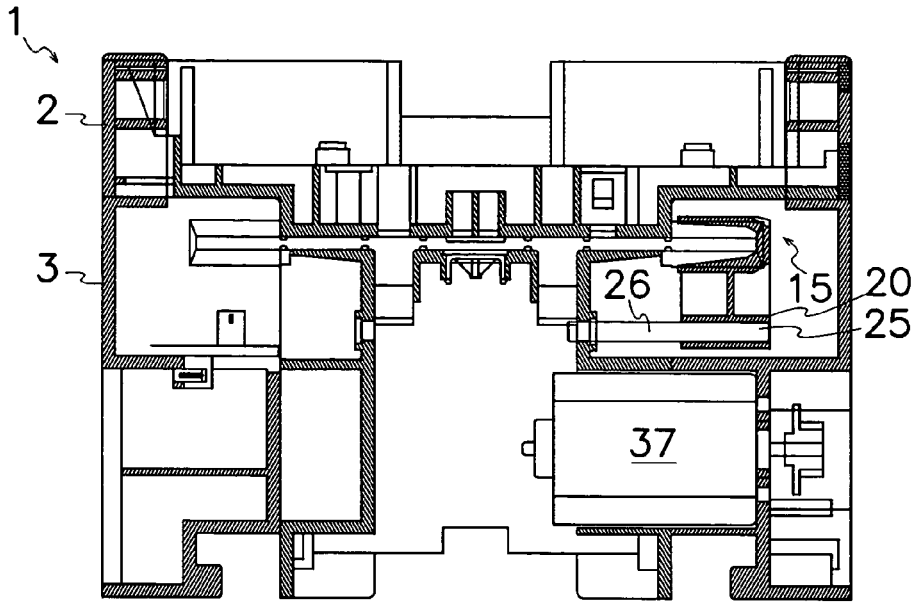
FIG. 6 is a cross sectional view taken along a line 6-6 of the bill validating apparatus shown in FIG. 3.

Each guide roller 40 is mounted above each belt 34 to form upper transfer unit 12 so that bottom surface of guide roller 40 downwardly extends from notch 41 formed in front block 5 and comes into contact to corresponding belt 34. As shown in FIG. 2, belts 34 of conveyer device 8 longitudinally extend from centering device 10 behind validation sensor 14 to continuously carry bill from centering device 10 through validation sensor 14 to stacker device 60. As shown in FIGS. 4 and 5, openings 27 are formed on the opposite sides of passageway 9 between lower and upper guides 31, 32 to allow either side of bill to widthwise or transversely protrude from either of openings 27. Located outside each of openings 27 are pinch jaws 15 formed into channeled U- or V-section of the size that can receive adjacent side edges of lower and upper guides 31, 32. Regardless of decentering, deviating or centered bill, side edges of bill widthwise or transversely protrude out of openings 27, a pair of pinch jaws 15 are moved toward each other to inwardly push either side edge of bill, thereby to let bill come into alignment with passageway 9 along the longitudinal axis.

As shown in FIGS. 4 and 5, each of pinch jaws 15 in centering device 10 includes a web 20 formed with an inner thread 21, feed screws 18 each of which includes an outer thread 19 meshed with inner thread 20 of pinch jaws 15. Feed screws 18 are drivingly connected to a centering motor 16 through a power transmission that comprises a drive gear 17 secured to feed screw 18, an intermediate small gear 22, an intermediate large gear 23 integrally formed with intermediate small gear 22, and a pinion 24 provided on a drive shaft of centering motor 16 in engagement with intermediate large gear 23. Also, each web 20 of pinch jaws 15 has a hole 25 for receiving a guide pin 26 attached to a vertical wall 30 of case 3 to guide pinch jaws 15 during sliding movement of pinch jaws 15 by rotation of feed screws 18. A pair of inner threads 21 of pinch jaws 15 are formed in the opposite directions, and likewise a pair of outer threads 19 of feed screws 18 are formed in the opposite directions so that when centering motor 16 is rotated in the forward direction, pinch jaws 15 are laterally, inwardly and synchronously moved toward each other along feed screws 18 and guide pins 26 because power transmission is rotated in the forward direction.

On the contrary, when centering motor 16 is rotated in the adverse direction, power transmission is rotated in the adverse direction to move pinch jaws 15 outwardly away from each other along feed screws 18 and guide pins 26. In this way, reversible centering motor 16 is operated to generate reciprocal movement of pinch jaws 15, however, centering motor 16 has the feature that a rotor of centering motor 16 arrives at a power-swing damping or slippage to forcibly hinder further rotation of centering motor 16 when a mechanical load over a predetermined level is applied to centering motor 16. To this end, preferable centering motor 16 includes one of stepping motors of power swing damping type, however, another type of motors such as servo motors can be used.

Figure 8:
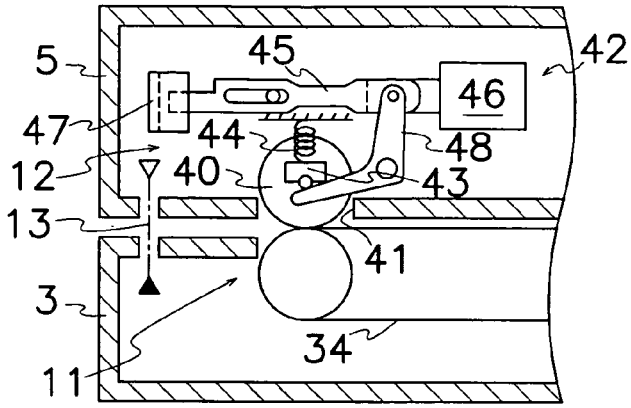
FIG. 8 is a cross sectional view of a release device in the contact position.
Figure 9:
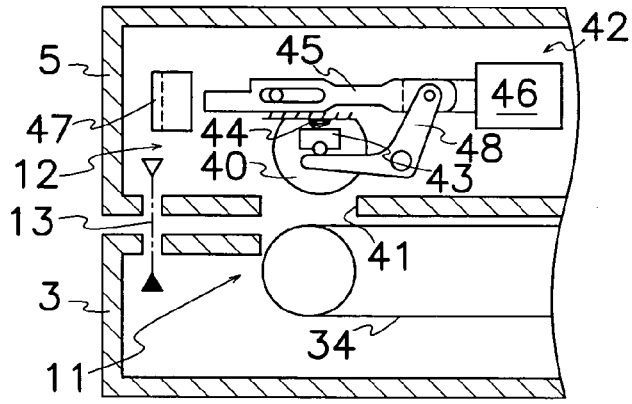
FIG. 9 is a cross sectional view of the release device in the separated position.

As shown in FIG. 8, validation control device 2 further comprises a release device 42 mounted in front block 5 for shifting or moving a pair of guide rollers 40 between a lower contact position wherein guide rollers 40 are in contact to corresponding belts 34 and an upper separated position wherein guide rollers 40 are apart from belts 34. Release device 42 comprises a shaft 52 mounted on bearings 43 for rotatably supporting guide roller 40, a spring 44 for resiliently and downwardly urging guide rollers 40 on belts 34 toward the contact position, solenoids 46 each provided with a plunger 45 for reciprocal movement of plunger 45, and a bell crank 48 for raising guide rollers 40 from the lower contact position to the upper separated position upon activation of solenoids 46. Plungers 45 are movable between an operative position fully extended from solenoids 46 as shown in FIG. 8 and an inoperative position partly retracted into solenoids 46 as shown in FIG. 9. One end of bell crank 48 is in pivoted connection to plunger 45, and the other is connected to one of bearings 43.

A pair of guide rollers 40 are usually in the lower contact position wherein guide rollers 40 are pressed on belts 34 by resilient force of springs 44 so that plungers 45 are in the operative position extended from solenoids 46. When solenoids 46 are activated, plungers 45 are drawn by solenoids 46 and moved from the extended to the retracted position to rotate bell crank 48 in the clockwise direction against resilient force of spring 44 so that guide roller 40 is moved from the lower contact position to the upper separated position. A position sensor 47 detects each free end of moved plungers 45 between the extended and retracted positions. Position sensor 47 is any optical sensor of non-contact type such as photocoupler for detecting free end of plunger 45, but may be another type of mechanical sensor such as microswitch for detecting mechanical contact to plunger 45.

Figure 3:
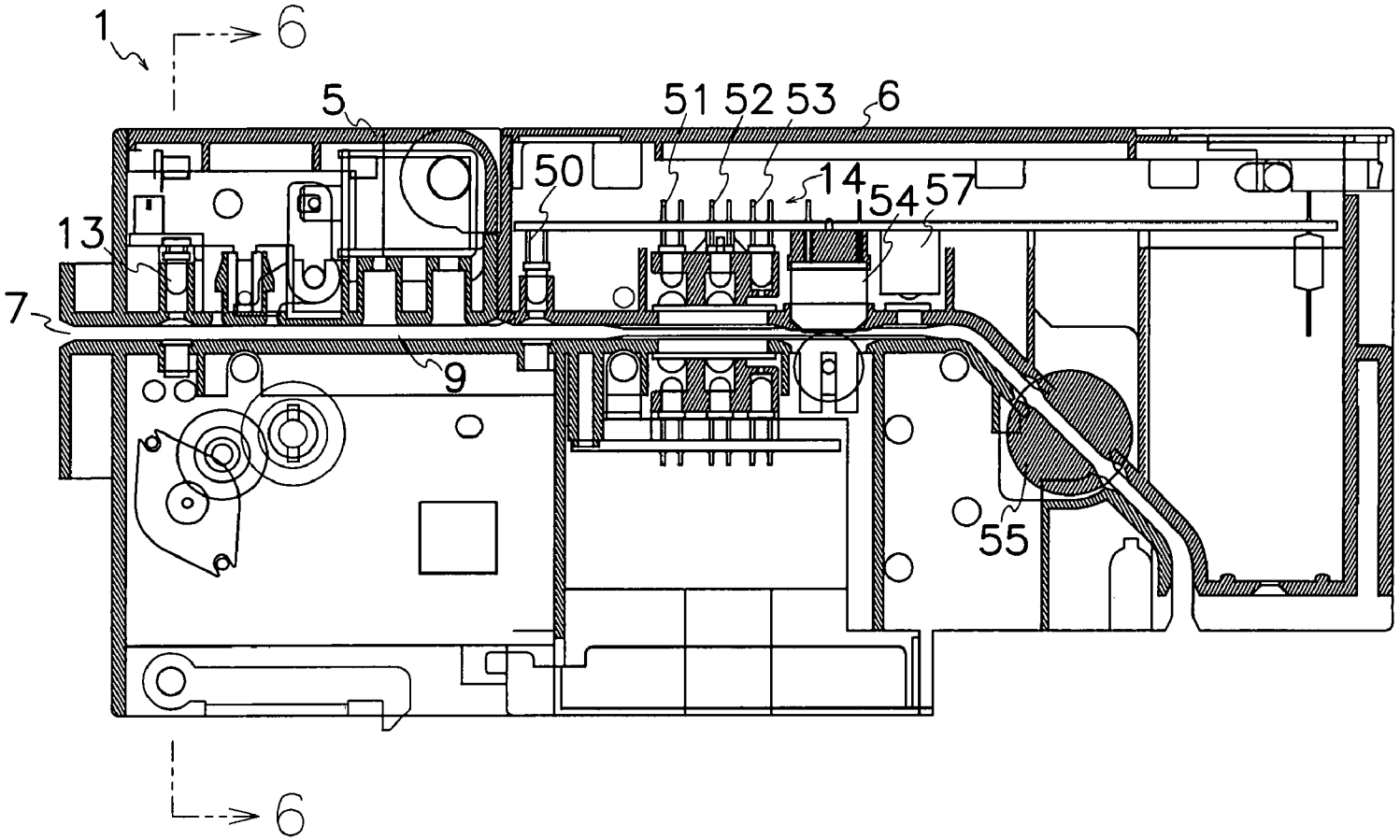
FIG. 3 is a cross sectional view taken along a line 3-3 of the bill validating apparatus shown in FIG. 5.

Inlet sensor 13 is disposed inside centering device 10 to detect bill inserted from inlet 7 between belts 34 of lower transport unit 11 and guide rollers 40 of upper transport unit 12 and produce a detection signal. Trigger sensor 50 detects bill transported from inlet 7 to the standby position at the inner end of centering device 10. As illustrated in FIG. 3, inlet sensor 13 is positioned in the vicinity of a front edge of upper and lower guides 32, 31 of front block 5 to immediately detect bill inserted from inlet 7, and trigger sensor 50 is positioned downstream outlet of front block 5 adjacent to inlet of upper and lower guides 32, 31 of rear block 6. Validation sensor 14 is mounted downstream trigger sensor 50 in upper and lower guides 32, 31 of rear block 6. Validation sensor 14 comprises a plurality of optical sensors 51, 52, 53 and magnetic sensor 54, and at least one of optical sensors 51, 52, 53 is an infrared ray sensor. Mounted downstream magnetic sensor 54 in downwardly oblique passageway 9 is a security device 55 for preventing unauthorized withdrawal of inserted bill that has a similar structure as shown in U.S. Pat. No. 6,179,110 to Katsutoshi Ohkawa et al.

Figure 10:
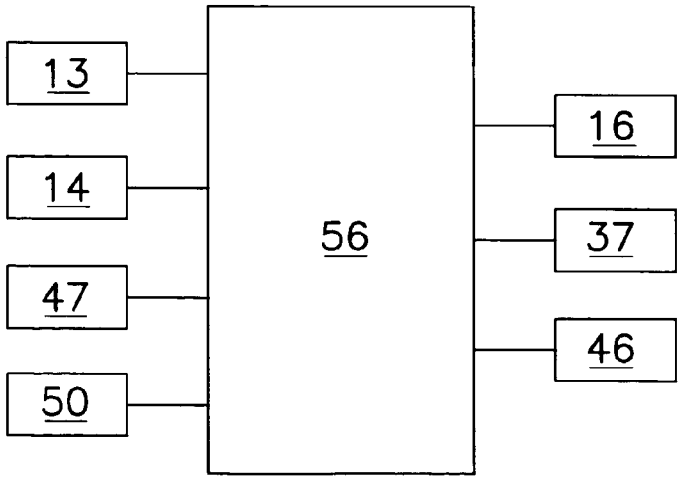
FIG. 10 is an electric circuit of the bill validating apparatus according to the present invention.

As shown in FIG. 10, inlet sensor 13, validation sensor 14, position sensor 47 and trigger sensor 50 are connected to corresponding input terminals of validation control circuit 56 whose output terminals are connected to centering motor 15, transfer motor 37 and solenoid 46. Validation control circuit 56 includes a suitable programmed one-chip microcomputer or integrated circuits to produce program-controlled outputs from output terminals in response to signals supplied to input terminals from inlet sensor 13, validation sensor 14, position sensor 47 and trigger sensor 50 and thereby control operation of centering device 10, transfer device 8 and release device 42.

Validation control circuit 56 is designed to: (i) drive conveyer device 8 to inwardly move bill along passageway 9 when inlet sensor 13 detects bill, (ii) cease driving of conveyer device 8 to keep bill in the standby position in passageway 9 when trigger sensor 50 detects bill, (iii) drive release device 42 to shift guide rollers 40 from the contact position to the separated position, (iv) activate centering device 10 to centralize bill along the longitudinal central axis of passageway 9, (v) drive release device 42 to return guide rollers 40 from the separated position to the contact position, and (vi) again drive conveyer device 8 to further inwardly move bill, (vii) authenticate bill in view of electric signals received from validation sensor 14, (viii) drive conveyer device 8 in the adverse direction to return bill to the standby position when validation control circuit 56 does not consider bill as genuine, (ix) again drive release device 42 to shift guide roller 40 from the contact position to the separated position, (x) activate centering device 10 to centralize bill along the longitudinal central axis of passageway 9, (xi) drive release device 42 to return guide rollers 40 from the separated position to the contact position, (xii) again drive conveyer device 8 to further inwardly move bill through validation sensor 14, and (xiii) again authenticate bill in view of electric signals from validation sensor 14.

Figure 11:
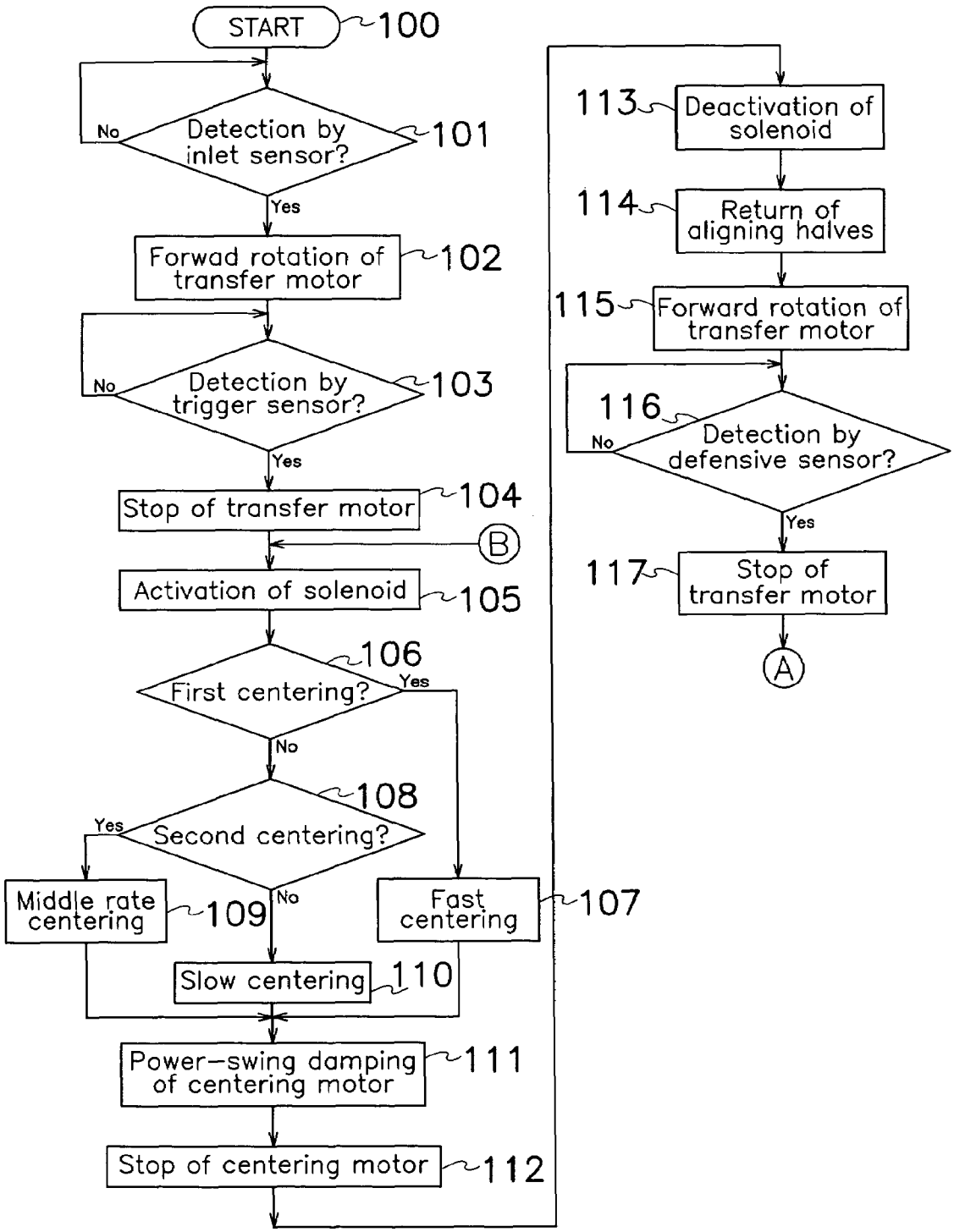
FIG. 11 shows a first half of a flow chart indicating the operational sequence of the bill validating apparatus according to the present invention.

In operation, bill validating apparatus 1 performs the processes described hereinafter in connection with flow charts shown in FIGS. 11 and 12.

Figure 7:
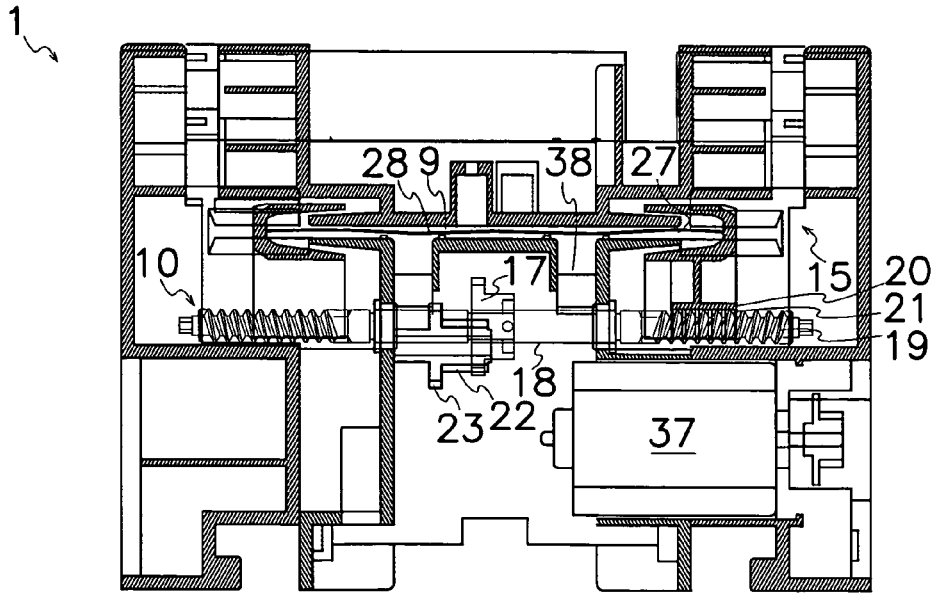
FIG. 7 is a cross sectional view similar to FIG. 5 showing a centered bill in passageway.

Bill validating apparatus 1 is energized to activate inlet sensor 13, and therefore, processing moves from Step 100 to Step 101 wherein validation control circuit 56 decides whether inlet sensor 13 detects insertion of bill into inlet 7 between lower and upper transfer units 11, 12 or not. Upon detection of bill's insertion by inlet sensor 13, validation control circuit 56 drives transfer motor 37 in the forward direction to nip bill between a pair of belts 34 and a pair of guide rollers 40 and inwardly move it along passageway 9. In Step 103, immediately upon detection of a tip of bill by trigger sensor 50, it forwards a detection signal to validation control circuit 56 that then ceases drive signals to transfer motor 37 to stop conveyer device 8 in Step 104 so that bill automatically comes to a stop at the standby position. Subsequently, validation control circuit 56 produces a drive signal to solenoid 46 to pull plunger 45 by solenoid 46 from the operative to the inoperative position in Step 105 so that bell crank 48 is rotated in the clockwise direction to lift bearings 43 and guide rollers 40 from the contact position of FIG. 7 to the separated position of FIG. 8. Accordingly, bill on belts 34 is released from guide rollers 40 of conveyer device 8 to allow lateral or transverse movement of bill.

Next, processing moves to Step 106 wherein validation control circuit 56 decides whether this is a first time of centering operation or not. For the first time centering operation, procedure goes to Step 107 wherein validation control circuit 56 supplies drive signals to centering motor 16 to conduct the first centering operation at a high rate so that a pair of pinch jaws 15 are laterally moved at a high speed toward each other through power transmission by centering motor 16 to come into contact to an edge of bill that is transversely moved to register longitudinal central axis of bill with that of passageway 9. In this case, each pinch jaw 15 is transversely and synchronously directed a same distance toward each other until pinch jaws 15 make bill come coaxial with longitudinal central axis of passageway 9. When centered, bill produces extremely increased resistance against the buckling by pinch jaws 15 due to stiffness of bill, and therefore, a rotor of centering motor 16 arrives at a power-swing damping or slippage to forcibly hinder further rotation of centering motor 16 when increased resistance over a predetermined level is applied to centering motor 16 (Step 111). At the moment, validation control circuit 56 ceases drive signals to centering motor 16 and stops movement of pinch jaws 15 (Step 112). In this case, validation control circuit 56 may count or measure cumulative elapsed time since the beginning of centering operation to stop centering motor 16 after a predetermined period of time elapses, otherwise, validation control circuit 56 may stop operation of centering motor 16 upon detecting transversely moved position of pinch jaws 15 by any sensor.

Here, processing moves to Steps 113 and 114 wherein validation control circuit 56 ceases electric supply to solenoid 46, and drives centering motor 16 in the adverse direction to return pinch jaws 15 to the original outermost position shown in FIG. 5. After that, validation control circuit 56 drives transfer motor 37 in the forward direction (Step 115) to further inwardly move bill from the standby position through validation sensor 14 that converts physical feature such as optical and magnetic feature of bill into electric signals and forward them to validation control circuit 56. Bill is further inwardly transported by conveyer device 8, and when defensive sensor 57 detects passage of bill, it produces a detection signal (Step 116) to validation control circuit 56 that ceases operation of transfer motor 37 (Step 117) to stop movement of bill immediately after passage through defensive sensor 57.

Figure 12:
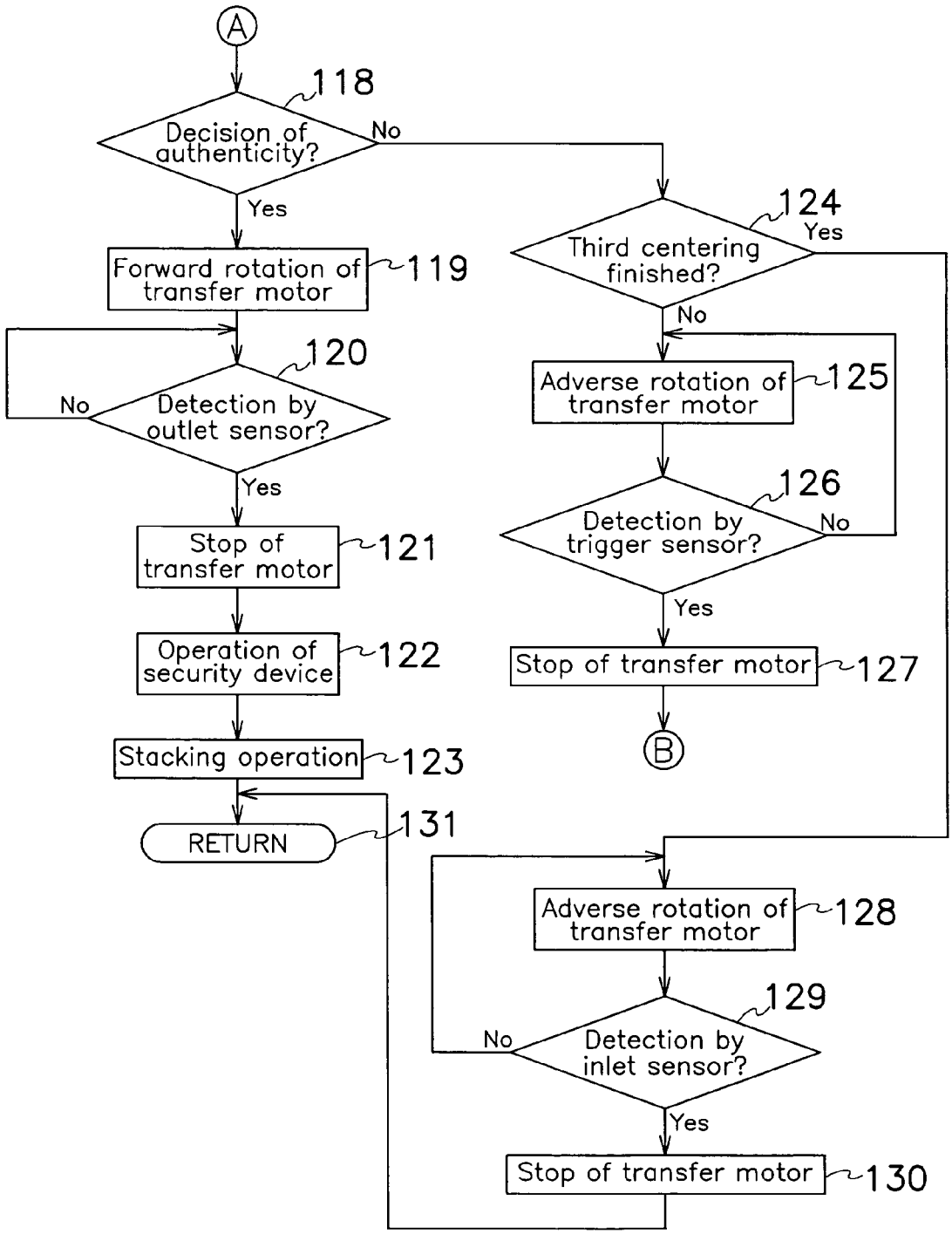
FIG. 12 is a second half of the flow chart continued from the first half of FIG. 11.

Following Step 117, processing moves to Step 118 of FIG. 12 wherein validation control circuit 56 determines in view of electric signals received from validation sensor 14 whether bill is genuine or not. When validation control circuit 56 recognizes bill as authentic, it forwards drive signals to transfer motor 37 to operate conveyer device 8 in the forward direction, and validation control circuit 56 determines whether an outlet sensor (not shown) provided at an outlet of passageway 9 of validation control device 2 detects passage of bill (Step 120). Upon deciding passage of bill through outlet sensor, validation control circuit 56 ends drive of transfer motor 37 (Step 121), rotates security device 55 (Step 122) and stores bill in stacker device 60, and proceeding moves to Step 131.

In Step 118, when validation control circuit 56 cannot judge bill to be genuine in view of electric signals received from validation sensor 14, operational function goes to Step 124 wherein validation control circuit 56 decides whether to finish three times of centering operation. Since the only first centering operation has been finished at this stage, processing moves to Step 125 and transfer motor 37 is rotated in the adverse direction to return bill to the standby position. Accordingly, validation control circuit 56 decides whether bill has passed trigger sensor 50 in Step 126, and upon the passage of bill, it stops drive of transfer motor 37 in Step 127 returning to Step 105 wherein bill has been returned to the standby position. Then, similarly to the foregoing case for the first centering operation, validation control circuit 56 again drives solenoid 46 to draw plunger 45 so that bell crank 48 rotates to raise guide roller 40 from the contact to the separated position in Step 105. After bill is released from conveyer device 8, validation control circuit 56 judges whether bill is subjected to a first centering operation. However, as this is a second centering operation, stage goes to Step 108 and validation control circuit 56 determines whether it should perform a second centering or not. As this is affirmative in Step 108, bill is then subjected to the second centering operation at a middle rate in Step 109 wherein pinch jaws 15 are laterally moved at a middle speed slower than the high speed in Step 107, and further Steps 113 to 118 are repeated. In Step 118, again authenticity of bill after the second centering operation is judged, and when validation control circuit 56 decides bill as genuine, processes are advanced from Steps 119 to 123 and Step 131. In Step 118, validation control circuit 56 does not decide as genuine, and then processing moves to Step 124 wherein validation control circuit 56 determines whether to finish a third centering operation. As the second centering operation has been finished at this stage, treatment through Steps 125 to 127 is conducted to resend bill to the standby position. Accordingly, processes from Steps 105 to 108 are repeated, and then, stage moves from Step 108 to Step 110 wherein a third centering operation is performed at a low rate to move pinch jaws 15 toward each other at a lower speed slower than the middle speed in Step 109, and then processing is repeated through Steps 113 to 118. In this way, repetitive centering operations utilize stepwise reduced or slower rates of the first to third centering operations while bill not decided as authentic is repetitively returned to the standby position several times. This means that stepwise increased or greater torques of centering motor 16 for the first to third centering operations stepwise increase the pushing force exerted on each side edge of bill by pinch jaws 15. Validation control circuit 56 may repeat the centering operation n-times by pinch jaws 15 until considers bill as genuine when it cannot be considered as genuine in view of detection signals from validation sensor 14, however, the number of centering operation may be determined as required. Accordingly, centering rate of the nth try may be slower than that of the $(n-1)^{th}$ try, and centering torque of the nth try may be greater than that of the $(n-1)^{th}$ try. This ensures the correct and automatic judgment by validation control circuit 56 on genuineness of bill through repetitive centering operation on passageway 9.

After the third centering operation, when bill is considered genuine in Step 118, processing moves through Steps 119 to 123 and Step 131. When bill is not considered genuine in Step 118, processing moves to Step 124 and Step 128 because the third centering operation is over. In Step 118, validation control circuit 56 drives transfer motor 37 in the adverse direction and decides whether inlet sensor 13 is turned OFF after bill passes inlet sensor 13 in Step 129. When inlet sensor is turned OFF, validation control circuit 56 stops drive of transfer motor 37 in Step 130 and goes to step 131.

As above-mentioned, in the present invention, inlet sensor 13 detects inserted bill into inlet 7 to immediately move bill on conveyer device 8 and center bill on conveyer device 8 for smooth insertion, transportation and centering of bill. Accordingly, the apparatus can be manufactured with the reduced number of structural components, thus resulting in easy production of the apparatus and fast and smooth sequential operations from insertion to validation of bill.

The aforesaid embodiment of the present invention can be varied in various ways. For example, in lieu of guide rollers 40 movable between the contact and separated positions, belts 34 may be moved between the contact and separated position relative to guide rollers 40. Also, coupons, securities and tickets other than bills may be used as valuable papers in the present invention.

What is claimed is:

1. An apparatus for discriminating valuable papers comprising:

conveyer means that has lower and upper transfer units to define a passageway between the lower and upper transfer units, centering means that has a pair of pinch jaws positioned on the opposite sides of an inlet of said passageway, said pinch jaws being movable toward and away from each other, an inlet sensor disposed in the vicinity of said inlet for detecting the valuable paper inserted from said inlet between said lower and upper transfer units to produce a detection signal, a trigger sensor disposed behind said inlet sensor along said passageway for detecting the paper moved to a standby position, a validation sensor disposed downstream of said trigger sensor for converting into electric signals a physical feature of the paper passing through the validation sensor, release means for shifting one of said lower and upper transfer units between a contact position wherein said one of said lower and upper transfer units is in contact to the other of said lower and upper transfer units and a separated position wherein said one is apart from the other, and validation control means for controlling each drive of said conveyer means, centering means and release means to conduct the following continuous operations (i) to (xiii):

(i) to drive said conveyer means to inwardly move the paper along the passageway when said inlet sensor detects the paper, (ii) to cease driving of said conveyer means to keep the paper in the standby position in the passageway when said trigger sensor detects the paper, (iii) to drive the release means to shift one of said lower and upper transfer units from the contact position to the separated position, (iv) to activate the centering means to centralize the paper along the longitudinal central axis of the passageway, (v) to drive the release means to return said one of said lower and upper transfer units from the separated position to the contact position, (vi) to again drive said conveyer means to further inwardly move the paper, (vii) to authenticate the paper in view of the electric signals received from said validation sensor, (viii) to drive the conveyer means in the adverse direction to return the paper to the standby position when the validation control means does not consider the paper as genuine, (ix) to again drive said release means to shift one of said lower and upper transfer units from the contact position to the separated position, (x) to activate the centering means to centralize the paper along the longitudinal central axis of the passageway, (xi) to drive the release means to return said one of said lower and upper transfer units from the separated position to the contact position, (xii) to again drive said conveyer means to further inwardly move the paper through said validation sensor, and (xiii) to again authenticate the paper in view of the electric signals from said validation sensor.

2. The apparatus for discriminating valuable papers as defined in claim 1, wherein the validation control means repeats the centering operation by said pinch jaws n-times when the paper is not considered as genuine until considered as genuine.

3. The apparatus for discriminating valuable papers as defined in claim 2, wherein the centering rate of the $n^{th}$ try is slower than that of the $(n-1)^{th}$ try, and a centering torque of the $n^{th}$ try is greater than that of the $(n-1)^{th}$ try.

4. The apparatus for discriminating valuable papers as defined in claim 2 or 3, wherein the validation control means drives the conveyer means in the adverse direction to return the paper to the inlet, when the paper is not considered as genuine at the $n^{th}$ centering operation.

5. The apparatus for discriminating valuable papers as defined in claim 1, wherein said lower transfer unit comprises a lower guide formed with at least an elongated slot, and a belt mounted in said elongated slot;

said upper transfer unit comprises an upper guide mounted in an upwardly spaced relation to said lower guide, and at least a guide roller movable by said release means between the contact position wherein said guide roller is in contact to said belt and the separated position wherein said guide roller is away from said belt;

said guide roller in the contact position is downwardly protruded from said upper guide for contact with said belt.

6. The apparatus for discriminating valuable papers as defined in claim 1, further comprising validation means that comprises a case; front and rear blocks pivotally connected to said case for upward opening, wherein said validation means accommodates said conveyer means, centering means, inlet sensor, trigger sensor and release means, and said centering means can be accessed after upward opening of said front block.

7. The apparatus for discriminating valuable papers as defined in claim 5, wherein said release means comprises a solenoid for upwardly moving a bearing of said guide roller, and a spring for resiliently urging said bearing toward the contact position.

8. The apparatus for discriminating valuable papers as defined in claim 1, wherein an opening is formed on each side of said passageway defined by the lower and upper guides to allow either side of the paper to transversely protrude from either opening, said pinch jaw is located outside each of said openings, said pinch jaw is formed into channel-shaped section of the size to receive each side edge of said lower and upper guides.

9. The apparatus for discriminating valuable papers as defined in claim 5, wherein said belt of said conveyer means continuously extends from the centering means behind said validation sensor to continuously transport the paper inserted into the inlet through said centering means and validator sensor.

10. The apparatus for discriminating valuable papers as defined in claim 5, wherein the paper on the belt is subjected to said centering operation, and then is moved through said validation sensor.

* * * * *